US011702770B2

(12) United States Patent
Bahlmann et al.

(10) Patent No.: US 11,702,770 B2
(45) Date of Patent: Jul. 18, 2023

(54) SPINNING MACHINE WITH A PLURALITY OF ADJACENTLY ARRANGED WORKSTATIONS AND METHOD FOR OPERATING A SPINNING MACHINE WITH A PLURALITY OF ADJACENTLY ARRANGED WORKSTATIONS

(71) Applicant: Maschinenfabrik Rieter AG, Winterthur (CH)

(72) Inventors: Bernd Bahlmann, Schrobenhausen (DE); Adalbert Stephan, Beilngries/Paulushofen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 135 days.

(21) Appl. No.: 17/235,300

(22) Filed: Apr. 20, 2021

(65) Prior Publication Data

US 2021/0332506 A1 Oct. 28, 2021

(30) Foreign Application Priority Data

Apr. 22, 2020 (DE) ..... 10 2020 110 993.8

(51) Int. Cl.
*D01H 5/68* (2006.01)
*D01H 4/50* (2006.01)
*D01H 15/00* (2006.01)

(52) U.S. Cl.
CPC ..... *D01H 5/68* (2013.01); *D01H 4/50* (2013.01); *D01H 15/00* (2013.01)

(58) Field of Classification Search
CPC .. D01H 5/68; D01H 5/66; D01H 4/00; D01H 4/02; D01H 4/48; D01H 4/50; D01H 4/52;

(Continued)

(56) References Cited

U.S. PATENT DOCUMENTS 3,842,579 A * 10/1974 Bartling ..... D01H 4/50 57/263
3,952,492 A * 4/1976 Miyazaki ..... D01H 11/006 57/305

(Continued)

FOREIGN PATENT DOCUMENTS

DE 2130684 A1 * 1/1973 ..... D01H 4/50
DE 100 17 209 A1 10/2001

(Continued)

OTHER PUBLICATIONS

German Patent Office Search Report, dated Feb. 26, 2021.
EPO Search Report, dated Sep. 14, 2021.

*Primary Examiner* — Shaun R Hurley
*Assistant Examiner* — Patrick J. Lynch
(74) *Attorney, Agent, or Firm* — Dority & Manning, P.A.

(57) ABSTRACT

A spinning machine and associated operational method include a plurality of adjacently arranged workstations that each have a spinning device for making a thread and a suction nozzle for seeking a thread end on a package. A first suction system includes a first vacuum source and a first vacuum duct extending along the workstations, the spinning devices of the workstations connected to the first suction system. A second suction system includes a second vacuum source and a second vacuum duct extending along the workstations, the suction nozzles of at least a first partial number of the workstations connected to the second suction system. The first suction system and the second suction system are pneumatically completely disconnected from one another.

16 Claims, 3 Drawing Sheets

(58) Field of Classification Search
CPC ..... D01H 11/00; D01H 11/005; D01H 15/00; B65H 69/061; B65H 69/06
See application file for complete search history.

(56) References Cited

U.S. PATENT DOCUMENTS

| | | | | | |
|---|---|---|---|---|---|
| 4,891,933 | A * | 1/1990 | Raasch | ..... | D01H 4/50 57/263 |
| 4,920,739 | A * | 5/1990 | Raasch | ..... | D01H 4/50 57/263 |
| 5,694,756 | A * | 12/1997 | Lindner | ..... | D01H 4/50 57/302 |
| 2014/0283496 | A1 * | 9/2014 | Stahlecker | ..... | D01H 4/48 57/263 |
| 2017/0350042 | A1 * | 12/2017 | Pohn | ..... | D01H 7/00 |

FOREIGN PATENT DOCUMENTS

| | | | | | |
|---|---|---|---|---|---|
| DE | 10233572 | A1 * | 3/2003 | ..... | D01H 4/50 |
| DE | 10 2005 036 485 | A1 | 2/2007 | | |
| DE | 10 2007 053 467 | A1 | 5/2009 | | |
| DE | 10 2016 110 147 | A1 | 12/2017 | | |
| DE | 10 2016 117 316 | A1 | 3/2018 | | |
| DE | 102016117316 | A1 * | 3/2018 | ..... | D01H 15/00 |
| EP | 3246279 | A1 * | 11/2017 | ..... | B65H 54/702 |
| WO | WO 2008/043408 | A1 | 4/2008 | | |
| WO | WO-2017081573 | A2 * | 5/2017 | ..... | D01H 5/66 |

* cited by examiner

SPINNING MACHINE WITH A PLURALITY OF ADJACENTLY ARRANGED WORKSTATIONS AND METHOD FOR OPERATING A SPINNING MACHINE WITH A PLURALITY OF ADJACENTLY ARRANGED WORKSTATIONS

FIELD OF THE INVENTION

The present invention relates to a spinning machine with a plurality of adjacently arranged workstations, each of which comprises a spinning device, impingeable with vacuum, for manufacturing a thread, and a suction nozzle, impingeable with vacuum, for seeking a thread end on a package. A first suction system, which comprises at least a first vacuum duct extending along the workstations of the spinning machine and at least a first vacuum source, is provided, wherein the spinning devices of the workstations are connected to the first suction system. Moreover, the invention relates to a method for operating this type of spinning machine, in which the spinning devices of the workstations are acted upon with vacuum by means of a first suction system.

BACKGROUND

At spinning machines, such as, for example, rotor spinning machines or air-jet spinning machines, a suction system is always present, which supplies the spinning devices at the individual workstations with vacuum. Moreover, vacuum is required at spinning machines for various types of maintenance work, such as, for example, seeking a thread after a thread break by means of a suction nozzle or storing a thread during piecing by means of a thread storage nozzle. Vacuum is also often necessary for cleaning processes and further maintenance operations.

In spinning machines, in which the workstations are serviced by one or multiple displaceable service unit(s), the suction nozzle and the thread storage nozzle are arranged in the displaceable service unit(s). If one of the spinning stations is to be serviced, the service unit positions itself in front of the relevant spinning station and docks at a machine-long vacuum duct extending above the spinning stations. As a result, the individual service devices of the service unit can be supplied with vacuum. In these types of machines, only a single spinning station can be simultaneously serviced or pieced by one service unit, however. Bottlenecks with respect to the vacuum supply therefore rarely occur in these types of machines.

In modern spinning machines, however, service units are often arranged directly at the spinning stations, and so these can automatically carry out the thread seeking as well as the piecing after a thread break. A suction nozzle, a thread storage nozzle, and/or other working elements impingeable with vacuum are arranged at every individual spinning station in this case.

DE 10 2005 036 485 A1 describes, for example, a spinning machine of this type, which is designed as a semi-automated rotor spinning machine. If, in the case of spinning machines of this type, a maintenance operation that requires suction is carried out simultaneously at multiple spinning stations, it is often the case that a sufficient vacuum level can no longer be made available. DE 10 2005 036 485 A1 therefore proposes arranging a second vacuum source in the machine, which can be manually connected, as necessary. It is at the discretion of the operator when it is necessary and when it is not necessary to connect the second vacuum source. Therefore, an optimal vacuum level cannot always be made available.

DE 10 2007 053 467 A1 therefore provides an open-end rotor spinning machine, in which the second vacuum source is automatically connected, as necessary. The second vacuum source is to be regulated according to the vacuum demand of the suction nozzles. According to one embodiment of DE 10 2007 053 467 A1, the suction nozzles of each side of the machine are connected to a separate vacuum duct, which is connected to the suction system of the spinning machine. When a package change is necessary at one of the spinning stations, the drive of the second vacuum source is automatically activated by the central control unit of the spinning machine, and so the suction nozzle can be supplied with an increased vacuum level.

A problem addressed by the present invention is that of further improving the vacuum supply of the spinning stations of a spinning machine with workstation-specific suction nozzles.

SUMMARY

The problem identified above is solved with the aid of the features of the independent claims. Additional objects and advantages of the invention will be set forth in part in the following description, or may be obvious from the description, or may be learned through practice of the invention.

A spinning machine contains a plurality of adjacently arranged workstations, each of which comprises a spinning device, impingeable with vacuum, for manufacturing a thread, and a suction nozzle, impingeable with vacuum, for seeking a thread end on a package, and at least a first suction system, which comprises at least a first vacuum duct extending along the workstations of the spinning machine and at least a first vacuum source. The spinning devices of the workstations are connected to the first suction system.

It is provided that the spinning machine comprises at least one second suction system, which comprises at least one second vacuum duct extending along the workstations of the spinning machine and at least one second vacuum source, wherein the suction nozzles of at least one first partial number of the workstations, preferably of all workstations, are connected to the second suction system, and that the at least one first suction system and the at least one second suction system are pneumatically completely disconnected from one another.

In an appropriate method for operating a spinning machine with a plurality of adjacently arranged workstations, each of which comprises a spinning device, impingeable with vacuum, for manufacturing a thread, and a suction nozzle, impingeable with vacuum, for seeking a thread end on a package, the spinning devices of the workstations are acted upon with vacuum by means of a first suction system.

It is provided that the suction nozzles of at least one first partial number of the workstations are acted upon by vacuum by means of a second suction system, wherein the first suction system and the second suction system are operated pneumatically independently of one another.

Due to the fact that the spinning machine comprises at least two suction systems, which are completely pneumatically disconnected from one another, the suction nozzles can be supplied completely independently of a main vacuum for the spinning devices. Therefore, sufficient vacuum is still available for seeking the thread even when the first suction system is overloaded, for example, due to a plurality of operations and/or connected vacuum consumers. Such a situation can occur, in particular, during a restart of the machine or during the start of a yarn lot when multiple lots are loaded. Due to the second suction system, the suction nozzles can nevertheless carry out the thread search at other workstations and the found thread end can be made available for the subsequent piecing process. The piecing can then take place as soon as sufficient vacuum is available again in the first suction system. Downtimes of the machine and/or of individual spinning stations can be reduced as a result, and, thereby, production can be increased. The suction systems, which are pneumatically disconnected from one another, can also be provided separately on each longitudinal side of the spinning machine. Two first suction systems and two second suction systems would be present in this case. It is also conceivable that further, pneumatically separated suction systems are provided for further vacuum consumers.

With respect to the method, it is therefore also advantageous when the suction nozzles of all workstations are acted upon by vacuum by means of the second suction system. As a result, the suction nozzles can be supplied, completely separately from the spinning devices, with a higher vacuum level, which can preferably also be adjusted separately.

Moreover, it is advantageous when the first suction system is impingeable and/or acted upon by a first vacuum level and the second suction system by a second vacuum level. Preferably, the second vacuum level is higher than the first vacuum level. As a result, only the second suction system, which supplies the suction nozzles, needs to be operated with the higher vacuum level, while the first suction system can be supplied, energy-efficiently, with a lower vacuum level. It is also conceivable, however, that the second vacuum level is lower than the first vacuum level, or that both are at the same level. This can be established, for example, in an application-specific manner, wherein the vacuum levels can also be adjusted differently at different times.

It is therefore advantageous when the first suction system and the second suction system are adjustable, preferably regulatable, independently of one another and/or are adjusted, preferably regulated, independently of one another in the method. The two suction systems each comprise, for this purpose, a separate vacuum source, which are each provided with a separate drive. As a result, the vacuum level in each suction system can be adjusted to the demand required at the time, which contributes to the energy-efficient operation. In principle, it would also be conceivable, of course, to drive both vacuum sources by means of a common drive. The different pressure levels can be implemented in this case by different compressed air sources or by a drive having different rotational speeds.

Moreover, it is advantageous, in addition, when each of the workstations comprises a working element impingeable with vacuum, in particular a thread storage nozzle, wherein the working elements of the workstations are connected to the first suction system. The working elements impingeable with vacuum generally require less vacuum, and so it is sufficient to connect these to the first suction system, which also supplies the spinning devices. It would also be conceivable, however, of course, to connect the working elements impingeable with vacuum to the second suction system or to temporarily assign one of the two suction systems to these working elements depending on the demand and availability. Working elements, impingeable with vacuum, of the workstations worth mentioning are, in particular, thread nozzles, which handle the thread during piecing, and/or suction nozzles, which remove thread pieces or trash. The thread nozzles include the aforementioned thread storage nozzles as well as thread-capturing nozzles.

It is also advantageous when each of the suction nozzles and/or each of the working elements impingeable with vacuum, in particular thread storage nozzles, are/is individually disconnectable from the suction system assigned thereto by means of a shut-off device. It is also advantageous with respect to the method when the suction nozzles and/or the working elements impingeable with vacuum are disconnected from the suction system assigned thereto by means of a shut-off device when they are not in operation. The suction nozzles as well as the working elements impingeable with vacuum are only temporarily required for carrying out certain service actions. These can be shut off by means of the shut-off device when they are not required, and so they are not unnecessarily acted upon by vacuum.

It is also advantageous when each of the suction nozzles and/or each of the working elements impingeable with vacuum are/is optionally connectable to the first suction system or to the second suction system by means of the shut-off device. With respect to the method, it is advantageous when, at at least one further partial number of the workstations, the suction nozzle(s) for seeking the thread end is/are disconnected from the second suction system and is/are connected to the first suction system. Even though the suction nozzles and/or the working elements impingeable with vacuum are connected, in principle, to one of the two suction systems, they can also be connected, as a result, at least temporarily, to the particular other suction system. For example, it is conceivable that only one low vacuum level is required for seeking the thread, in certain applications. In this case, the suction nozzles at at least one partial number of the workstations can also be connected to the first suction system with the lower vacuum level and, as a result, operated more energy-efficiently. It is also conceivable, for example, when multiple workstations are to be pieced simultaneously, to temporarily connect the working elements impingeable with vacuum, in particular the thread storage nozzles, in this case to the second suction system. The temporary connection of the suction nozzles and/or of the working elements impingeable with vacuum to one of the two suction systems can preferably also take place in a yarn lot-related manner.

It is also advantageous with respect to the method when the suction nozzles for seeking the thread end are optionally connected to the first suction system or to the second suction system as a function of the type of thread that is manufactured. This can also take place in a yarn lot-related manner, as mentioned above.

It is also advantageous, when the spinning machine is loaded with multiple lots, when the workstations of the first partial number and/or the workstations of the further partial number process the same yarn lot. In other words, for example, the suction nozzles of a partial number of workstations that process a first yarn lot can be connected to the first suction system and the suction nozzles of a further partial number of workstations that process a second yarn lot can be connected to the second suction system.

It is also advantageous when the shut-off device is designed to comprise multiple ducts, wherein the shut-off device is connected to the first suction system via a first duct and to the second suction system via a second duct. For this purpose, the shut-off device can contain, for example, a sliding valve or a turning valve. Alternatively, the two ducts of the shut-off device can also be disconnectable independently of one another by means of two separate shut-off elements.

Moreover, it is advantageous with respect to the method when the first vacuum level and/or the second vacuum level are/is increased at the beginning of the search for the thread end. As a result, the thread seeking can be carried out particularly reliably and, once the thread has been found, can be switched to an energy-efficient, lower vacuum level in order to hold and handle the thread.

BRIEF DESCRIPTION OF THE DRAWINGS

Further advantages of the invention are described in the following exemplary embodiments.

DETAILED DESCRIPTION

Figure 1:
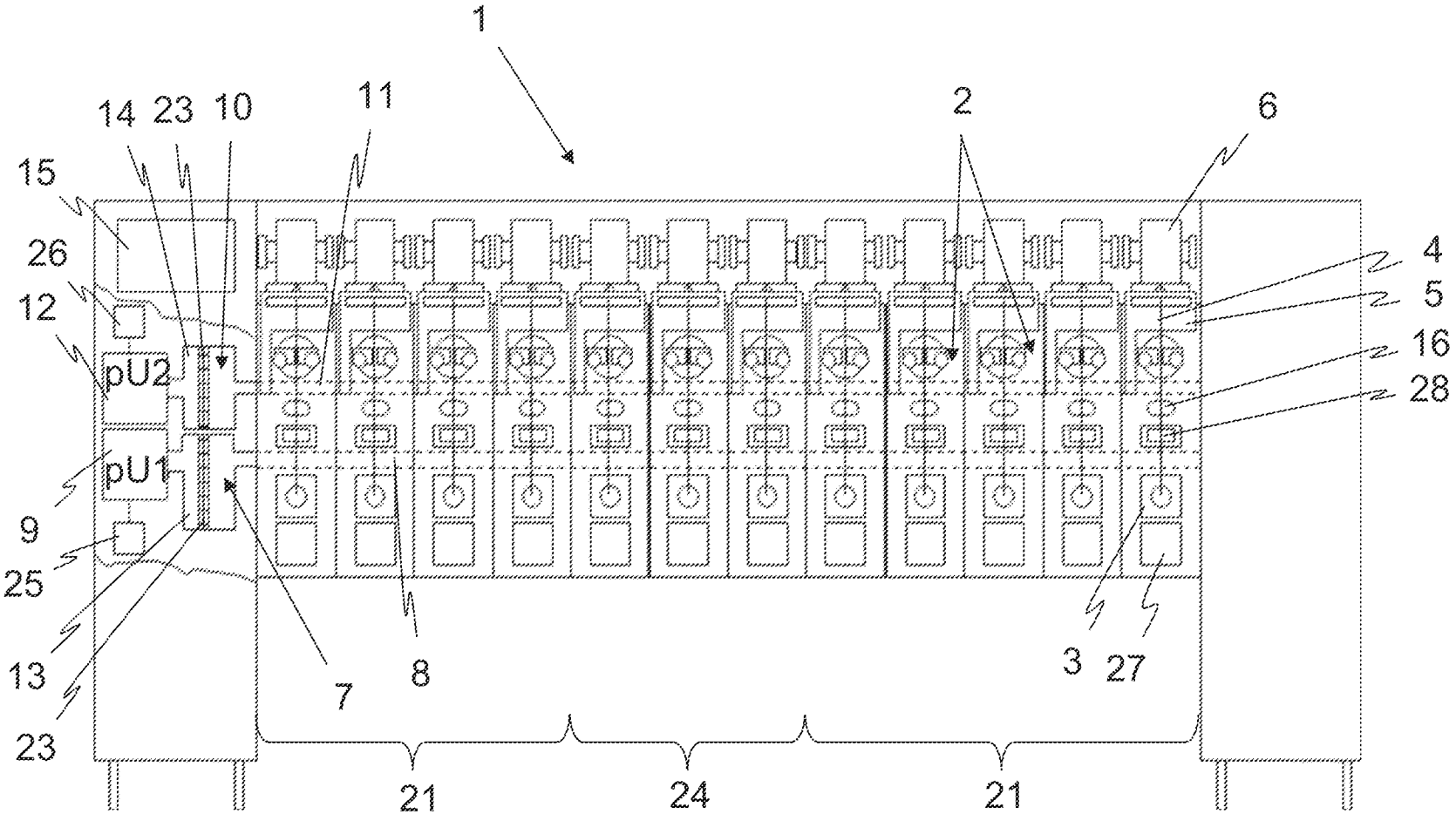
FIG. 1 shows a front view of a spinning machine with two suction systems as an overview representation.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the exemplary embodiments, features that are identical or at least comparable with respect to their design and/or mode of operation are provided with identical reference numbers. Moreover, these are explained in detail only at their first mention, while only the differences from the previously described exemplary embodiments are discussed in the subsequent exemplary embodiments. Moreover, for the sake of clarity, often only one or only a few of several identical components and/or features is/are labeled.

Figure 3:
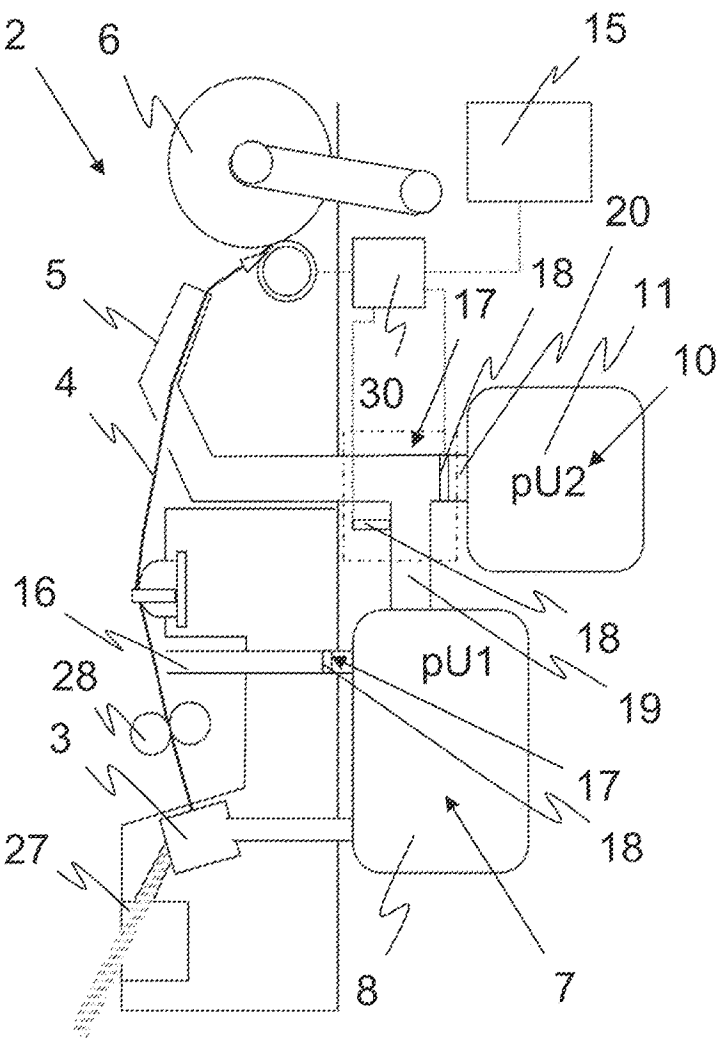
FIG. 3 shows a schematic, partially cutaway side view of a workstation of a spinning machine according to a second embodiment.
Figure 2:
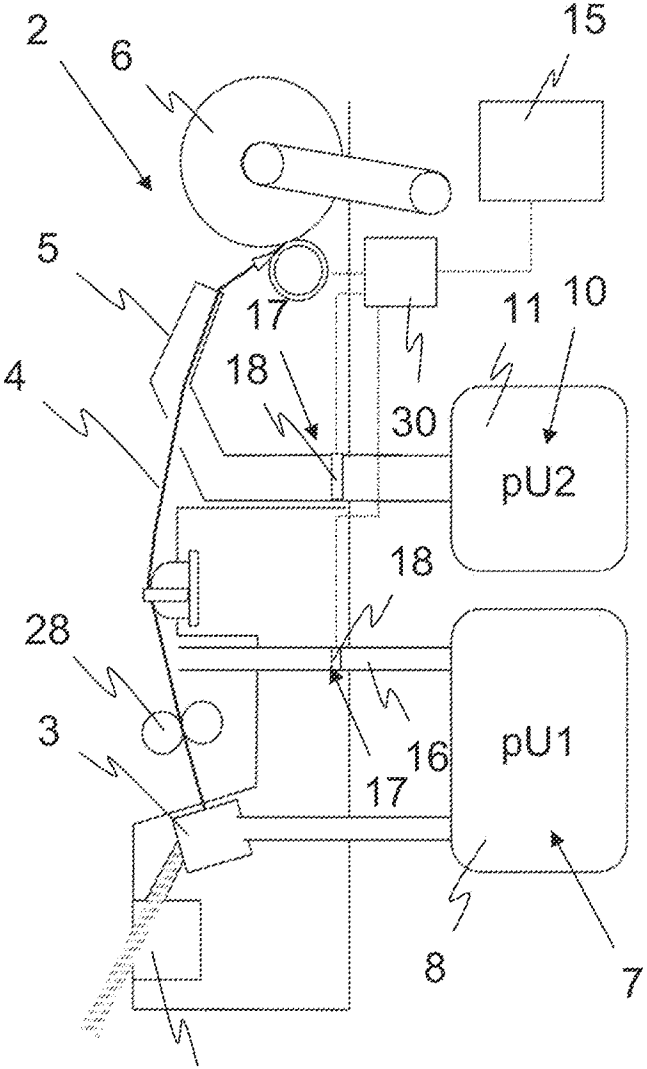
FIG. 2 shows a schematic, partially cutaway side view of a workstation of the spinning machine according to FIG. 1.

FIG. 1 shows a front view of a spinning machine 1 in a schematic overview representation. The spinning machine 1 comprises a plurality of adjacently arranged workstations 2, which are arranged between two frames (not labeled) in the present case. Each of the workstations 2 comprises a spinning device 3, which is supplied with a fiber material by a supply device 27. If the spinning device 3 is designed as a rotor spinning device, the supply device 27 is an opening roller. If the spinning device 3 is designed as an air-jet spinning device, however, the supply of the fiber material generally takes place via a drafting system. The produced thread 4 is drawn off by means of a take-off device 28 and wound onto a package 6. Moreover, the spinning machine 1 comprises a central control unit 15 for controlling the functions of the spinning machine 1. The central control unit 15 can cooperate with workstation control systems 29 of the individual workstations 2, as shown in FIGS. 2 and 3.

Each of the workstations 2 comprises a workstation-specific suction nozzle 5 for seeking a thread end traveling on the package 6 after a thread break or also after a cleaning step. If the suction nozzle 5 has sought and sucked in the thread end, it can be transferred to further handling units of the workstation 2, which can operate mechanically or pneumatically, to be pieced again. The workstation 2 comprises, as handling units, for example, working elements 16 impingeable with vacuum, such as thread storage nozzles, thread-catching nozzles, and the like. In the present case, a workstation-specific thread storage nozzle is shown as an example of a working element 16 impingeable with vacuum. During piecing, temporary excess lengths of the thread generally arise, which result during start-up due to different rotational speeds of the working elements of the workstations 2, in particular of the take-off device 28 and of the winding device (not represented). These excess lengths can be taken up by means of the thread storage nozzle. The workstations 2 can comprise further working elements 16 impingeable with vacuum, for example, thread-catching nozzles, which are required during the piecing of the thread 4, or suction nozzles for removing thread pieces or trash at the workstation 2.

To supply the workstation 2 with vacuum, the spinning machine 1 comprises a first suction system 7 and a second suction system 10. Vacuum is required during the regular operation for the spinning devices 3 and during the piecing for the spinning devices 3, the suction nozzles 5, and the thread storage nozzles represented here by way of example as a working element 16. The vacuum is also required at different times during the piecing. For example, initially only the suction nozzle 5 requires vacuum, in order to seek the thread end, while the spinning device 3 requires vacuum only after the thread end has been found. The thread storage nozzle also requires vacuum only after the thread end has been found.

In order to supply these suction nozzles 5 and the further working elements 16 impingeable with vacuum in an optimal way with a vacuum at the optimal level, the two suction systems 7, 10 are pneumatically completely separated from one another. The first suction system 7 comprises at least one first vacuum duct 8, which extends along the workstations 2. The first vacuum duct 8 is acted upon by a first vacuum source 9, which is connected to the first vacuum duct 8 via a first waste collection box 13. The second suction system 10 also comprises a second suction duct 11, which extends along the workstations 2 and is acted upon by a second vacuum source 12 via a second waste collection box 14. A filter 23 is arranged in each of the two waste collection boxes 13, 14, in order to filter out fibers and thread pieces carried along with the air. In the present example, a first drive 25 is assigned to the first vacuum source 9 and a second drive 26 is assigned to the second vacuum source 12. It would also be conceivable, however, to provide a common drive 25, 26 for the two vacuum sources 9, 12.

In the present example, the first vacuum duct 8 as well as the second vacuum duct 11 extend across the entire length of the spinning machine 1 and/or the entire plurality of workstations 2. It also lies within the scope of the invention, however, that the first suction system 7 comprises multiple first vacuum ducts 8, which each extend across only a portion of the workstations 2 and are acted upon by multiple first vacuum sources 9. The same also applies, of course, for the second suction system 10. It is also conceivable that multiple first suction systems 7 and/or multiple second suction systems 10 are present, which are pneumatically independent of one another. For example, at a spinning machine 1, the two longitudinal sides of the spinning machine could be acted upon by vacuum separately from one another. In this case, a first vacuum system 7 and a second vacuum system 10, i.e., four vacuum systems 7, 10 in all, would be present on each of the two longitudinal sides. Mixed forms are also conceivable, of course, for example, with two separate first vacuum systems 7 for the negative pressure for spinning, but a common second suction system 10 for the suction nozzles. More than the two aforementioned vacuum systems for further vacuum consumers can also be present.

The spinning devices 3 of all workstations 2 are connected to the first suction system 7. According to the present representation, the suction nozzles 5 of all workstations 2 are also connected to the second suction system 10 and/or, here, to the second vacuum duct 11. Advantageously, the vacuum level pU2 of this second vacuum system 10 is set considerably higher than the vacuum level pU1 of the first suction system 7. As a result, a high efficiency of thread seeking can be achieved without unnecessarily affecting the spinning conditions in the spinning devices 3. Since, in the present case, the second vacuum source 12 has a separate, second drive 26, an optimal second vacuum level pU2 can also be set manually or automatically and, if necessary, also regulated by a separate regulating unit in each operating condition and/or also in the case of a different number of presently active suction nozzles 5.

According to the present exemplary embodiment, the thread storage nozzles of all workstations 2 are connected to the first suction system 7. This is apparent, in particular, in FIG. 2, which shows a schematic side view of a workstation 2 of the spinning machine 1. The thread storage nozzles and/or, in general, the working elements 16 impingeable with vacuum generally require only a lower vacuum level, and so the connection to the first suction system 7 with the first, lower vacuum level pU1 is more advantageous with respect to energy.

As is also apparent from FIG. 1, it is also possible that the plurality of workstations 2 is subdivided into two or also multiple groups or partial numbers 21, 24. In the present case, for example, the workstations 2 of the represented longitudinal side of the spinning machine 1 are subdivided into a first partial number 21 and a second partial number 24. Since the workstations 2 of the spinning machine 1 are designed to be autonomous, i.e., after an interruption of the spinning process they can automatically restart the spinning process, the subdivision of the workstations into groups can take place completely independently of structural conditions, such as sections or longitudinal sides of the spinning machine 1. Preferably, the subdivision into such groups takes place in a lot-related manner, and so the first partial number 21 processes a first yarn lot and the second partial number 24 processes a second yarn lot. A subdivision into even more groups or partial numbers 21, 24 can also take place, of course. Workstations 2 belonging to a partial number 21, 24 also do not necessarily need to be situated next to one another.

According to another embodiment of the invention, it is therefore also possible not to connect all suction nozzles 5 of all workstations 2, but rather only the suction nozzles 5 of a first partial number 21, to the second suction system 10. The suction nozzles 5 of the second partial number 24, however, can be connected to the first suction system 7. This can be dependent, for example, on the position of the particular workstation 2 within the machine, since the vacuum level pU1, pU2 is usually higher close to the vacuum sources 9, 12 than at a greater distance therefrom. The partial numbers 21, 24 can also be connected to the first suction system or to the second suction system in a lot-specific manner. This can also take place temporarily or in an alternating manner, as explained with reference to FIGS. 4 and 5.

FIG. 2 shows a workstation 2 of the spinning machine 1 from FIG. 1 in a schematic, partially cutaway side view. As previously described with respect to FIG. 1, the suction nozzle 5 is connected to the second suction system 10 and the spinning device 3 as well as the thread storage nozzle are connected to the first suction system 7. As is also apparent, the thread storage nozzle as well as the suction nozzle 5 are each individually disconnectable, i.e., separable from the suction system 7, 10, to which they are connected, by means of an independent shut-off device 17. As a result, the suction nozzles 5 and the thread storage nozzles can be disconnected from the vacuum when they are not required. For this purpose, each shut-off device 17 contains a shut-off element 18, which, in the present example, is controlled by the workstation control system 29. Of course, the shut-off element 18 could also be controlled by the control unit 15, however.

FIG. 3 shows a workstation 2 of a spinning machine 1 according to a second embodiment in a schematic, cutaway side view. In contrast to FIG. 2, the suction nozzle 5 can be optionally connected to the first suction system 7 with the first, lower vacuum level pU1 and also to the second suction system 10 with the second, higher vacuum level pU2. This can be advantageous, for example, when the spinning machine 1 is loaded with multiple lots, since, in the case of yarn lot-specifically lower requirements on the suction effect, the suction system 7, 10 with the lower vacuum level pU1, pU2 can be selected, in order to save energy.

The present shut-off device 17 is designed with multiple ducts for this purpose. The shut-off device 17 is connected to the first suction system via a first duct 19 and to the second suction system 10 via a second duct 20. Each of the ducts 19, 20 is disconnectable by means of a separate shut-off element 18.

Figure 4:
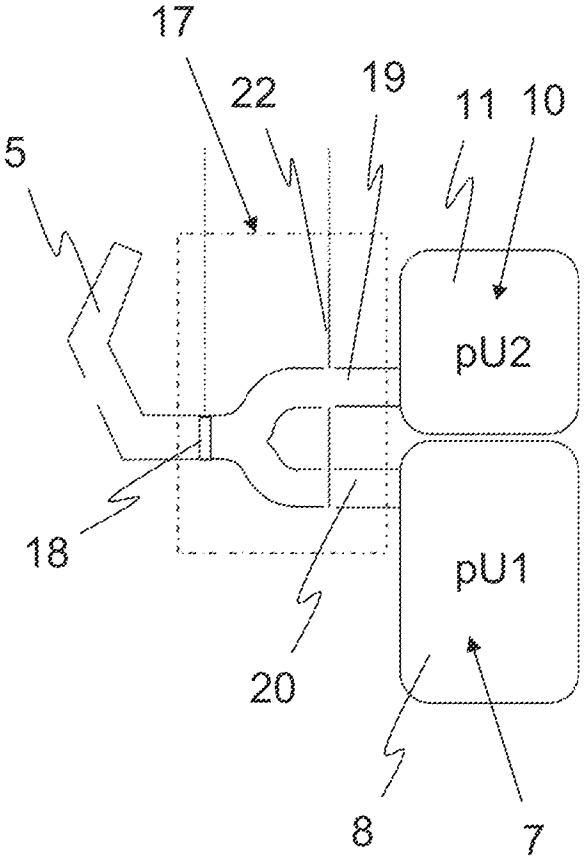
FIG. 4 shows a schematic representation of a shut-off device in a first condition.

FIG. 4 shows a schematic representation of a further shut-off device 17 in a first condition. In contrast to FIG. 3, the two ducts 19, 20 are not disconnectable by means of separate shut-off elements 18, however, but rather the shut-off device 17 comprises only one single shut-off element 18 for shutting off the suction nozzle 5. The shut-off device 17 also makes it possible, however, to optionally connect the suction nozzle 5 to the first suction system 7 or to the second suction system 10. For this purpose, the shut-off device 17 contains a sliding valve 22. In FIG. 4, the sliding valve 22 is in a first position, in which it disconnects the first duct 19 and, thereby, the connection to the first suction system 7 and releases the second duct 20 and, thereby, the connection to the second suction system 10.

Figure 5:
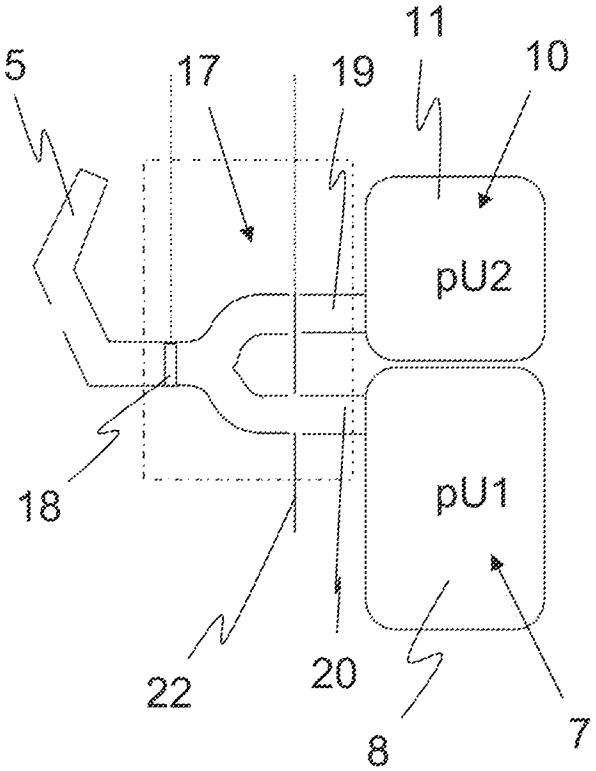
FIG. 5 shows a schematic representation of the shut-off device from FIG. 4 in a second condition.

FIG. 5, however, shows the shut-off device 17 from FIG. 4 in a second condition. The sliding valve 22 is located in a second position, in which it releases the first duct and, thereby, the connection to the first suction system 7 and disconnects the second duct 20 and, thereby, the connection to the second suction system 11.

The present invention is not limited to the exemplary embodiment that has been represented and described. Modifications within the scope of the claims are also possible, as is any combination of the features, even if they are represented and described in different exemplary embodiments.

LIST OF REFERENCE NUMBERS

1 spinning machine
2 workstation
3 spinning device
4 thread
5 suction nozzle

6 package
7 first suction system
8 first vacuum duct
9 first vacuum source
10 second suction system
11 second vacuum duct
12 second vacuum source
13 first waste collection box
14 second waste collection box
15 control unit
16 working element impingeable with vacuum
17 shut-off device
18 shut-off element
19 first duct
20 second duct
21 first partial number
22 sliding valve
23 filter
24 second partial number
25 first drive
26 second drive
27 supply device
28 take-off device
29 workstation control system
pU1 first vacuum level
pU2 second vacuum level

The invention claimed is:

1. A spinning machine, comprising:

a plurality of adjacently arranged workstations, each of the workstations comprising a spinning device impingeable with vacuum to manufacture a thread, and each of the workstations having a workstation-specific suction nozzle impingeable with vacuum that seeks a thread end on a package;

at least one first suction system comprising at least one first vacuum source and at least one first vacuum duct extending along the workstations;

the spinning devices of the workstations connected to the first suction system;

at least one second suction system comprising at least one second vacuum source and at least one second vacuum duct extending along the workstations;

the second suction system isolated from the first suction system such that the first suction system comprises a first vacuum level (pU1) and the second suction system comprises an independent second vacuum level (pU2);

wherein the suction nozzles of at least a first partial number of the workstations are connected to the second suction system; and wherein the the second vacuum level (pU2) is greater than the first vacuum level (pU1).

2. The spinning machine of claim 1, wherein that the first suction system and the second suction system are independently adjustable.

3. The spinning machine of claim 1, wherein, in addition to the suction nozzle, each of the workstations further comprises at least one working element connectable to the first suction system.

4. The spinning machine of claim 3, further comprising a shut-off device configured to individually disconnect the suction nozzle from the second suction system and the working element from the first suction system.

5. The spinning machine of claim 4, wherein the shut-off device is configured to perform one or both of: connect the suction nozzle to the first suction system instead of the second suction system; or connect the work element to the second suction system instead of the first suction system.

6. The spinning machine of claim 5, wherein the shut-off device comprises multiple ducts and is connectable to the first suction system via a first duct and to the second suction system via a second duct.

7. The spinning machine of claim 3, wherein the working element comprises a thread storage nozzle.

8. A method for operating a spinning machine, wherein the spinning machine includes a plurality of adjacently arranged workstations each having a spinning device impingeable with vacuum to manufacture a thread and a workstation-specific suction nozzle impingeable with vacuum to seek a thread end on a package, the method comprising:

acting upon the spinning devices with a vacuum via at least one first suction system;

acting upon the suction nozzles of at least one first partial number of the workstations with a vacuum via at least one second suction system;

pneumatically operating the at least one first suction system and the at least one second suction system pneumatically independent of one another such that the first suction system has a first vacuum level (pU1) and the second suction system has an independent second vacuum level (pU2) that is greater than the first vacuum level (pU1).

9. The method of claim 8, comprising adjusting the first suction system and the second suction system independently of one another.

10. The method of claim 8, wherein the suction nozzles of all workstations are acted upon by the vacuum via the second suction system.

11. The method of claim 8, comprising acting upon at least one working element at each of the workstations that is in addition to the suction nozzle with a vacuum via the first suction system.

12. The method of claim 11, further comprising disconnecting the suction nozzles from the second suction system and the working elements from the first suction system with a shut-off device when the suction nozzles and working elements are not operating.

13. The method of claim 8, further comprising disconnecting the suction nozzles from the second suction system and connecting the suction nozzles to the first suction system.

14. The method of claim 13, wherein the suction nozzles are connected to the first suction system or to the second suction system as a function of a type of thread manufactured at the workstation.

15. The method of claim 14, wherein the first vacuum level (pU1) or the second vacuum level (pU2) are increased at a beginning of the search for the thread end with the suction nozzles.

16. The method of claim 8, wherein the spinning machine is loaded with multiple different lots for manufacturing different threads, the first partial number of workstations processing the same lot and an additional number of the workstations processing a same different lot, and an additional number of the workstations processing the same lot or a same different lot.

* * * * *